United States Patent [19]

Di Rosa

[11] 4,213,398

[45] Jul. 22, 1980

[54] DAMPENED SUSPENDED CARRIER SUSPENSION

[75] Inventor: Gaetano Di Rosa, Pino Torinese, Italy

[73] Assignee: F.A.T.A.-Fabrica Apparecchi Di Sollevamento E Trasporto Ed Affini S.p.A., Turin, Italy

[21] Appl. No.: 910,939

[22] Filed: May 30, 1978

[30] Foreign Application Priority Data

Jul. 14, 1977 [IT] Italy ..... 68637 A/77

[51] Int. Cl.[2] ..... B61B 5/00; B61D 15/00; B61F 5/00

[52] U.S. Cl. ..... 105/150; 105/149; 105/152; 188/83

[58] Field of Search ..... 105/149, 150, 152; 188/83

[56] References Cited

U.S. PATENT DOCUMENTS

| | | | |
|---|---|---|---|
| 865,113 | 9/1907 | Louden | 105/150 |
| 1,411,845 | 4/1922 | Dodge | 105/150 |
| 3,106,171 | 10/1963 | Julien | 105/149 X |
| 3,168,874 | 2/1965 | Atanasoff | 105/150 X |
| 3,973,504 | 8/1976 | Knudsen | 105/149 |

FOREIGN PATENT DOCUMENTS

| | | | |
|---|---|---|---|
| 468410 | 11/1928 | Fed. Rep. of Germany | 105/150 |
| 536655 | 10/1931 | Fed. Rep. of Germany | 105/150 |

*Primary Examiner*—Howard Beltran
*Attorney, Agent, or Firm*—Sughrue, Rothwell, Mion, Zinn and Macpeak

[57] ABSTRACT

A load carrying device for an overhead conveyor, comprising a carriage for movement along an overhead rail and a load-bearing container suspended from the carriage by two substantially parallel connecting elements pivoted at their upper ends to the carriage and at their lower ends to the load-bearing container to form a pivoted parallelogram linkage which permits the two connecting elements to swing when the carriage is accelerated or decelerated sharply while holding the load-bearing container upright; energy dissipation means, such as one or more friction bush or hydraulic shock absorber are also provided to damp the oscillation of the container and limit its movement in order to cushion the articles in the container against shock.

4 Claims, 5 Drawing Figures

DAMPENED SUSPENDED CARRIER SUSPENSION

The present invention relates generally to overhead conveyors, and particularly to load carrying devices for overhead conveyors of the kind comprising a carriage movable along an elevated rail and carrying a load container which is suspended therefrom. Such load containers often take the form of an open framework supporting a plurality of substantially horizontal load bearing platforms or shelves.

If such overhead conveyors are used in circumstances where it is necessary to start and stop the carriages frequently during the work cycle the load container or containers is or are caused to swing and this, particularly since high accelerations are frequently involved, often results in the loads, which are carried on one or a plurality of the horizontal load bearing surfaces or shelves, toppling or falling due to the inclination of the container while swinging.

Swinging of the container is particularly likely to lead to displacement of the load if the container extends downwardly from the carriage to any considerable extent as in the case of containers having a large number of superimposed load bearing surfaces or shelves for carrying loads.

The present invention seeks, therefore, to provide a load carrying device which will not have the above mentioned disadvantage.

According to the present invention, there is provided a load-carrying device for an overhead conveyor, comprising a carriage movable along a rail and supporting, via connection means, a load-bearing container, in which the connection means comprise a pair of elongate connecting elements pivotally connected at an upper end to a part of the carriage and at the lower end to a part of the load-bearing container so as to form a pivoted parallelogram linkage, and energy dissipation means associated with the connecting elements for damping the swinging movements thereof which occur upon starting and stopping of the carriage in its movement along the rail.

Load bearing elements formed as embodiments of the present invention can be accelerated from rest to maximum velocity, and braked to rest, with only restricted and damped swinging. Moreover even such swinging as does take place is such that the load bearing surfaces always remain substantially horizontal so that the chances of the load falling are considerably reduced.

This is particularly advantageous when the load consists of fragil articles, such as, for example, casting cores before firing.

In a preferred embodiment of the invention the energy dissipation means comprises at least one friction device operable to brake the rotation of at least one of the ends of at least one of the connecting elements about an associated pivot pin.

Preferably, each friction device comprises a bush of material having a high coefficient of friction interposed between one of the pivot pins and an associated bore in the cooperating end of the associated connecting element. This latter, apart from being economically advantageous, has the further advantage of being usable on overhead conveyors in which the load carrying containers pass through high temperature environments, for example furnaces or autoclaves, or other such situations in which it would not be possible to use hydraulic shock absorbers as the energy dissipation means.

Various embodiments of the invention will now be more particularly described, by way of example, with reference to the accompanying drawings, in which.

Figure 1:
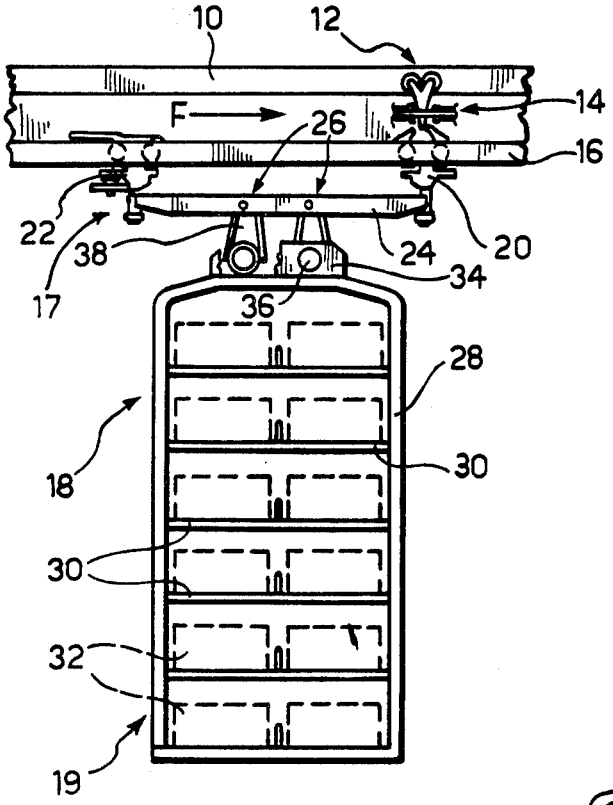
FIG. 1 is a side view of the load carrying device of an overhead conveyor of the two rail type, which is formed as an embodiment of the invention.
Figure 2:
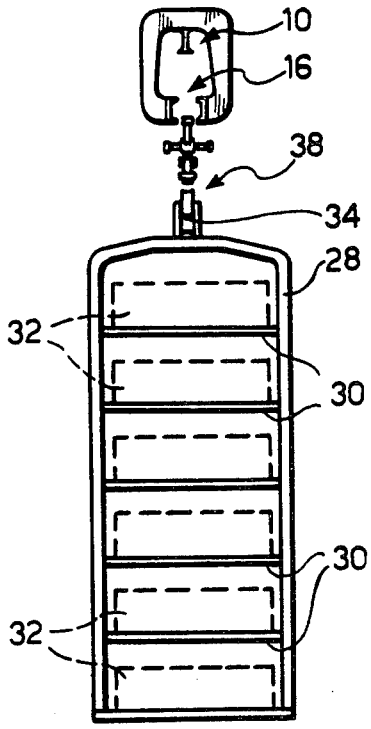
FIG. 2 is a diagrammatic end view of the load-carrying device of FIG. 1.
Figure 3:
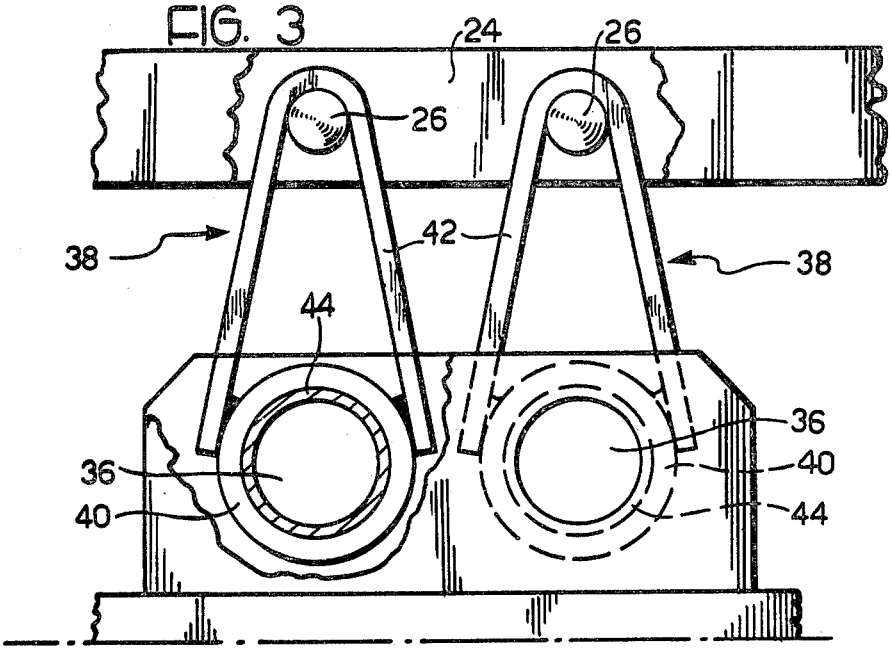
FIG. 3 is a view, partially sectioned and on an enlarged scale, of a component part of the load carrying device of FIG. 1.

Referring first to FIGS. 1 to 3 of the drawings there is shown a section of an overhead conveyor rail assembly of the two rail type having an upper rail 10 and a pair of lower rails 16. On the upper rail run a plurality of trucks 12, only one of which is shown in the drawing, which support and guide a chain 14 which draws the trucks 12 along the upper rail 10.

The pair of lower rails 16 of the overhead conveyor support and guide load carrying devices, generally indicated 18, only one of which is shown in FIGS. 1 and 2 of the drawings.

The load carrying device 18 comprises a carriage, generally indicated 17, and a load-bearng container generally indicated 19. The carriage 17 comprises a pair of trucks 20 and 22 which roll on the lower rails 16, and a pair of coupling bars 24 which extend side-by-side and parallel to one another between the two trucks 20, 22. At an intermediate position the coupling bars carry a pair of pivot pins 26. The direction of travel of the load carrying device 18 is indicated by the arrow F in FIG. 1.

The load-bearing container 19 comprises an outer framework 28 across which extend a plurality of substantially horizontal load-bearing surfaces or shelves 30 on which are stacked articles to be conveyed indicated by the broken line 32 in FIGS. 1 and 2.

Projecting upwardly from the outer frame 28 of the load-bearing container 17 is a bracket comprising two parallel side-by-side plates 34 having two pairs of aligned holes for receiving two pivot pins 36. Between the coupling bar 24 of the carriage 17 and the bracket 34 of the load-bearing container 17 extend a pair of connector elements 38 each of which comprises a cylindrical sleeve 40 in which is engaged a respective one of the pins 36 passing through the bracket 34, and a U-shape component 42 which is joined at its ends to the sleeve, for example by means of welding. Each U-shape component 42 is engaged over a respective one of the pivot pins 26 passing through the coupling bars 24. A bush 44 of material having a high coefficient of friction is interposed under pressure between the pin 36 and the sleeve 40 of each connector element 38.

This interconnection between the carriage 17 and the load-bearing container 19 constitutes a parallelogram linkage which opposes any tendency of the container 17 to swing about a single centre, permitting the container to move with respect to the carriage, by turning of the two connector elements 38 about the pivots 36 upon starting or stopping of the carriage 17 so that the load-bearing surfaces 30 always remain horizontal; the chances of the loads 32, which are placed upon these surfaces, falling or toppling are thus significantly reduced. Moreover, the connection described above offers the further advantage that such swinging as does occur due to acceleration or deceleration of the carriage 17 is restricted and damped, due to the presence of the bushes 44 which have a high coefficient of friction.

Figure 4:
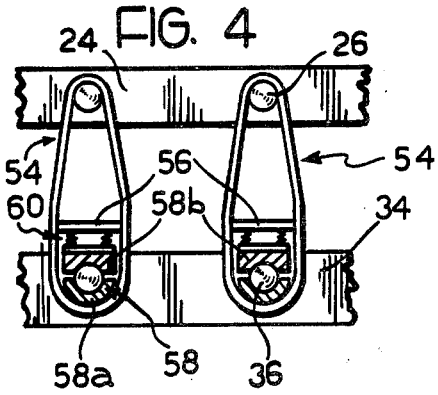
FIG. 4 is a side view of a second embodiment of the invention.

In the alternative embodiment illustrated in FIG. 4, the components are the same apart from the connector elements, generally indicated 54, which replace the connector elements 38 of the embodiment of FIGS. 1 to 3. The components which are identical in FIGS. 1 to 4 are indicated with the same reference numerals.

Connection between the coupling bar 24 and the load-bearing container 17 from which projects the bracket 34 is effected by means of a pair of connecting elements 54 each being in the form of a loop having two longer sides joined by arcuately curved portions. The longer sides are connected to each other by a transverse element 56 close to the lower curved end at which the element is pivoted to the bracket 48 by means of the pivot pins 36 as in the embodiment of FIGS. 1 to 3. In the lower portion of the connecting elements 54 between the transverse element 56 and the adjacent lower curved end of the connecting element itself, is housed a bush 58 of material having a high coefficient of friction, through which bush passes one of the pivot pins 36 of the bracket 34. The bush 58 is split along a median plane into a lower bush portion 58*a*, which engages the lower surface of the pin 36, and an upper bush portion 58*b* which is pressed against the upper surface of the pin 36 by springs 60 compressed between the said upper bush portion 58*b* and the transverse element 56.

The embodiment illustrated in FIG. 4 has the advantage that any possible slack, for example due to wear after an extended period of use, between the bushes 58 and the pins 36 is taken up by the action of the springs 56. Moreover adjustment of the braking action of the bushes 58 can be effected by substituting the springs 60 by stronger or weaker springs to increase or decrease the braking effect.

The embodiments illustrated in FIGS. 1 to 4 are particularly suitable for use in circumstances where the load carrying devices pass through high temperature environments, for example furnaces or autoclaves, because the bushes 44 and 58 of high coefficient of friction maintain their characteristics regardless of the temperature.

Figure 5:
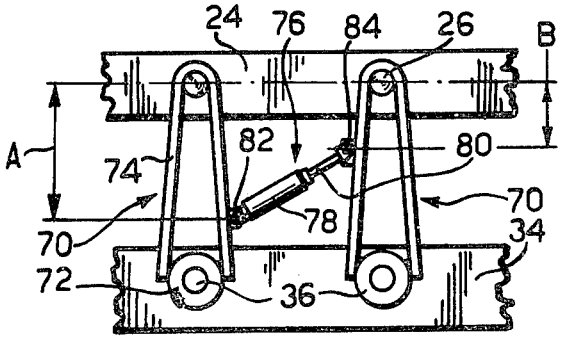
FIG. 5 is a side view of a further embodiment of the invention.

If the overhead conveyor does not lead the load carrying devices through a high temperature environment then the embodiment illustrated in FIG. 5 can be used. In this embodiment those component parts which are the same as in the embodiments of FIGS. 1 to 4 are indicated with the same reference numerals. Thus, the coupling bar 24 and the bracket 34 are each provided with a pair of pivot pins 26 and 36 respectively. Connection of the load-bearing container to the coupling bar 62 is effected in this embodiment by means of two connecting elements 70 having the same general form as the connecting rods 38 in the embodiment illustrated in FIGS. 1 to 3. Each connecting element 70 comprises a lower sleeve 72 through which passes one of the pins 68, and an upper U-shape element 74 the two ends of which are secured to the sleeve 72 and the curved portion of each of which passes over the upper surface of a respective one of the pins 66.

Generally indicated 76 is a telescopic hydraulic shock absorber having a cylinder 78 pivotally mounted by a pivotal coupling 82, to a bracket projecting from one connecting element towards the other, and a piston rod 80 pivotally connected by a pivotal coupling 84 to a bracket projecting from the other connecting element towards the said one connecting element. The pivotal connection 82 of the cylinder 78 to the connecting element 70 is spaced from the corresponding pivot pin 26 which joins the connecting element 70 to the coupling bar 24 by a distance A, and the pivotal connection 84 of the piston rod 80 to the connecting element 70 is spaced from the pivot pin 26 which joins the connecting element 70 to the coupling bar 24 by a distance B which is less than the distance A. Thanks to this arrangement the swinging movements of the load-bearing container suspended from the bracket 34 are damped by the hydraulic shock absorber 76 because the angular movement of the connecting rods 70 induces relative movement between the piston rod 80 and the cylinder 78.

The load carrying device has been described above with reference to an overhead conveyor of the two-rail kind, but it will be understood that the invention is not limited to this but could also be used advantageously in an overhead conveyor of the monorail kind, particularly if it has a high working speed and is subject to frequen starts and stops.

What is claimed is:

1. A load-carrying device for an overhead-rail conveyor, comprising:

a carriage movable along the rail, a load-bearing container, and means suspending said load bearing container from said carriage, said means comprising:

pivot pins carried by said carriage and said load bearing container, a pair of elongate connecting elements, each of said connecting elements having an upper end pivotally connected to one of said pivot pins which is carried by said carriage, and a lower end pivotally connected to one of said pivot pins which is carried by said load-bearing container, so as to form a pivoted parallelogram linkage, and at least one friction bush of material having a high coefficient of friction interposed between at least one end of one of said connecting elements and the pivot pin which is pivotally connected to said at least one end so as to brake turning movements of this connecting element about its pivot.

2. A load-carrying device as set forth in claim 1, wherein each of said connecting elements is provided with two friction bushes interposed between each end of the connecting element and the pivot pin which is pivotally connected thereto.

3. A load-carrying device as set forth in claim 2, wherein each connecting element includes:

a generally U-shape part having two arms, lying in a vertical plane parallel to the direction of the rail, and a bight portion, and connection means forming the lower pivotal connection of the element, said two arms being connected to said connection means and said bight portion passing over the upper surface of the pivot pin forming the pivotal connection of the connecting element to the carriage.

4. A load carrying device as set forth in claim 1, wherein said at least one friction bush is carried in a fixed position by said at least one end of one of the connecting elements and is formed as two parts one on each side of the pivot pin about which the connecting element is pivoted, said device further comprising resilient biasing means carried by said connecting element and urging said two parts of the friction bush towards one another.

* * * * *